US009695791B2

(12) United States Patent
Akimoto et al.

(10) Patent No.: US 9,695,791 B2
(45) Date of Patent: Jul. 4, 2017

(54) FUEL SUPPLY DEVICE FOR ENGINE

(75) Inventors: Motoki Akimoto, Tochigi (JP); Kuniaki Takahashi, Kakunda (JP); Tatsuya Miura, Kakuda (JP); Satoshi Tanaka, Kakuda (JP)

(73) Assignee: Keihin Corporation, Tokyo (JP)

( * ) Notice: Subject to any disclaimer, the term of this patent is extended or adjusted under 35 U.S.C. 154(b) by 468 days.

(21) Appl. No.: 14/112,372

(22) PCT Filed: Apr. 17, 2012

(86) PCT No.: PCT/JP2012/060327

§ 371 (c)(1),
(2), (4) Date: Dec. 3, 2013

(87) PCT Pub. No.: WO2012/144483

PCT Pub. Date: Oct. 26, 2012

(65) Prior Publication Data

US 2014/0096745 A1 Apr. 10, 2014

(30) Foreign Application Priority Data

Apr. 21, 2011 (JP) ..... 2011-094762

(51) Int. Cl.
*F02M 69/04* (2006.01)
*F02M 37/08* (2006.01)
*F02M 37/20* (2006.01)

(52) U.S. Cl.
CPC ..... *F02M 69/04* (2013.01); *F02M 37/08* (2013.01); *F02M 37/20* (2013.01)

(58) Field of Classification Search
USPC ..... 123/445, 469, 470, 472, 495, 505, 509
See application file for complete search history.

(56) References Cited

U.S. PATENT DOCUMENTS 5,094,212 A * 3/1992 Kawaguchi et al. ..... 123/470
6,158,975 A * 12/2000 Dill ..... F02M 37/14 123/509

(Continued)

FOREIGN PATENT DOCUMENTS

JP H03-117680 A 5/1991
JP 2001-263128 A 9/2001

(Continued)

OTHER PUBLICATIONS

Machine Translation of JP 2006142842 A PDF file name: "JP2006142842A_Machine_Translation.pdf".*

*Primary Examiner* — Carlos A Rivera
*Assistant Examiner* — Ruben Picon-Feliciano
(74) *Attorney, Agent, or Firm* — Carrier Blackman & Associates, P.C.; William D. Blackman; Jingli Wang

(57) ABSTRACT

A fuel supply device for an engine is provided in which a throttle body is provided with an electrically operated fuel pump, wherein a base member integrally having a base portion that extends in the vertical direction on one side of the throttle body and a housing tube portion that is formed into a bottomed tube shape having an end wall communicating with the base portion is linked integrally to a body, a pump housing case that forms a fuel storage chamber is formed from the housing tube portion and a bottomed tubular housing cover joined to the housing tube portion via a seal member and is disposed beneath the body, and a vapor discharge path for discharging vapor generated in a fuel storage chamber is formed in the base portion so as to extend in the vertical direction and communicate with the fuel storage chamber.

5 Claims, 4 Drawing Sheets

(56) References Cited

U.S. PATENT DOCUMENTS

| | | | | |
|---|---|---|---|---|
| 6,494,184 | B2 | 12/2002 | Nishimura et al. | |
| 6,802,210 | B2 * | 10/2004 | Mitani | F02M 37/106 73/114.43 |
| 8,056,535 | B2 * | 11/2011 | Matsuda | F02D 9/02 123/337 |
| 2001/0023685 | A1 * | 9/2001 | Nawa et al. | 123/470 |
| 2007/0113830 | A1 | 5/2007 | Koito et al. | |
| 2008/0063546 | A1 * | 3/2008 | Itoh | F02M 37/08 417/423.7 |
| 2008/0271714 | A1 * | 11/2008 | Mitsuhashi | F02M 37/08 123/497 |
| 2009/0090330 | A1 * | 4/2009 | Tateishi | F02M 25/0854 123/357 |
| 2009/0183715 | A1 * | 7/2009 | Yamamoto | F02M 37/0082 123/497 |

FOREIGN PATENT DOCUMENTS

| | | | | |
|---|---|---|---|---|
| JP | 2003-254187 | A | | 9/2003 |
| JP | 2005-105987 | A | | 4/2005 |
| JP | 2005-133672 | A | | 5/2005 |
| JP | 2006-142842 | A | | 6/2006 |
| JP | 2006142842 | A | * | 6/2006 |
| JP | 2006-257979 | A | | 9/2006 |
| JP | 2011-012649 | A | | 1/2011 |

* cited by examiner

FUEL SUPPLY DEVICE FOR ENGINE

TECHNICAL FIELD

The present invention relates to a fuel supply device for an engine in which a throttle body that includes a body having an intake path communicating with an intake port of the engine, a throttle valve axially supported on the body so as to open and close the intake path, and a fuel injection valve mounted on the body so as to inject fuel into the intake path is provided with an electrically operated fuel pump that supplies fuel to the fuel injection valve.

BACKGROUND ART

Such a fuel supply device for an engine is already known from Patent Document 1.

RELATED ART DOCUMENTS

Patent Documents

Patent Document 1: Japanese Patent Application Laid-open No. 2005-105987

SUMMARY OF INVENTION

Problems to be Solved by the Invention

In the fuel supply device for an engine disclosed by Patent Document 1 above, a pump housing case housing a fuel pump and forming a fuel storage chamber is formed from a bottomed housing tubular portion formed integrally with a body of a throttle body and a lid member blocking the open end of the housing tubular portion, but it cannot be said that the ease of assembly of the fuel pump is excellent.

The present invention has been accomplished in light of such circumstances, and it is an object thereof to provide a fuel supply device for an engine that enables the device to be made compact, enhances the ease of assembly of the components, and enhances the strength and toughness toward a load generated by vibration, etc.

Means for Solving the Problems

In order to attain the above object, according to a first aspect of the present invention, there is provided a fuel supply device for an engine in which a throttle body that comprises a body having an intake path communicating with an intake port of the engine, a throttle valve axially supported on the body so as to open and close the intake path, and a fuel injection valve mounted on the body so as to inject fuel into the intake path is provided with an electrically operated fuel pump that supplies fuel to the fuel injection valve, characterized in that a base member integrally having a base portion that extends in a vertical direction on one side of the throttle body and a housing tube portion that is formed into a bottomed tube shape having on one end side an end wall communicating with a lower part of the base portion is linked integrally to the body, a pump housing case that houses the fuel pump and forms a fuel storage chamber is formed from the housing tube portion and a bottomed tubular housing cover joined to the housing tube portion via a seal member and is disposed beneath the body, the throttle valve is fixed to a valve shaft pivotably and axially supported on the body so as to intersect the intake path, a throttle drum is fixed to, or an actuator is linked to, one end part of the valve shaft of the throttle body, the throttle body is disposed on one side of the base member, the housing tubular portion that houses the fuel pump is disposed beneath the throttle body and on one side of the base portion, and a bus bar providing an electrical connection between an ECU board and the fuel pump is insert-bonded to a part of the housing tubular portion that is connected to the base portion.

According to a second aspect of the present invention, in addition to the first aspect, a housing recess is formed in a portion of the base member that faces a side opposite to the throttle body, and the ECU board is housed in the housing recess.

According to a fifth aspect of the present invention, in addition to any one of the second to fourth aspects, a regulator for adjusting the pressure of fuel discharged from the fuel pump is disposed on the end wall so as to be present between a discharge orifice of the fuel pump and the fuel storage chamber in order to utilize the vapor discharge path as a return passage.

According to a sixth aspect of the present invention, in addition to the fifth aspect, the regulator is disposed above the discharge orifice of the fuel pump, and an intake orifice of the fuel pump is disposed beneath the discharge orifice.

Moreover, according to a seventh aspect of the present invention, in addition to the third aspect, the fuel pump is housed in the pump housing case so that the fuel pump is inclined upward in going toward the end wall side.

Effects of the Invention

In accordance with the first aspect of the present invention, since the base member integrally having the base portion that extends in the vertical direction on one side of the throttle body and the housing tube portion that is formed into the bottomed tube shape having on one end side the end wall communicating with the lower part of the base portion is linked integrally to the body, the pump housing case that houses the fuel pump and forms the fuel storage chamber is formed from the housing tube portion and the bottomed tubular housing cover joined to the housing tube portion via the seal member and is disposed beneath the body, it is possible to enhance the strength of a part of the pump housing case that is provided so as to be connected to the base member; furthermore, it is possible to simply insert the fuel pump into the bottomed tubular housing tubular portion and easily mount the housing cover, and it is possible to easily mount the fuel pump on the base member side while achieving a compact layout having high strength and toughness toward vibration.

Furthermore, since the bus bar providing an electrical connection between the ECU board and the fuel pump is insert-bonded to the part of the housing tubular portion that is connected to the base portion, it becomes easy to carry out electrical connection of the fuel pump to the ECU board, and it becomes possible by means of the bus bar to enhance the strength of the part where the housing tube portion is connectedly provided on the base member.

In accordance with the second aspect of the present invention, since the housing recess is formed in a portion of the base member that faces the side opposite to the throttle body, and the ECU board is housed in the housing recess, when the fuel pump and the ECU board are both assembled, they do not interfere with each other, assembly becomes easy, the base member can be reinforced, and housing the ECU board within the housing recess enables the ECU board to be protected.

In accordance with the fifth aspect of the present invention, since the regulator is disposed on the end wall so as to be present between the discharge orifice of the fuel pump and the fuel storage chamber in order to utilize the vapor discharge path as a return passage, it is possible to employ a compact structure by eliminating the necessity for additionally providing a return passage other than the vapor discharge path, and vapor contained in fuel that has returned from the regulator toward the fuel storage chamber side escapes from the upper part of the fuel storage chamber toward the vapor discharge path side. Furthermore, since the regulator is disposed on the end wall of the bottomed tubular housing tubular portion provided integrally with the base member, it is possible to easily assemble the regulator from the open end side of the housing tubular portion.

In accordance with the sixth aspect of the present invention, since the regulator is disposed above the discharge orifice of the fuel pump, and the intake orifice of the fuel pump is disposed beneath the discharge orifice, it is possible to make it difficult for vapor contained in fuel that has returned from the regulator toward the fuel storage chamber side to be sucked in by the fuel pump, and it is also possible to shorten the length of the passage for guiding fuel returning from the regulator toward the fuel storage chamber side.

Moreover, in accordance with the seventh aspect of the present invention, since the fuel pump is inclined upward in going toward the end wall side, it is possible to more easily vent vapor within the fuel storage chamber toward the vapor discharge path side.

EXPLANATION OF REFERENCE NUMERALS AND SYMBOLS

Figure 1:
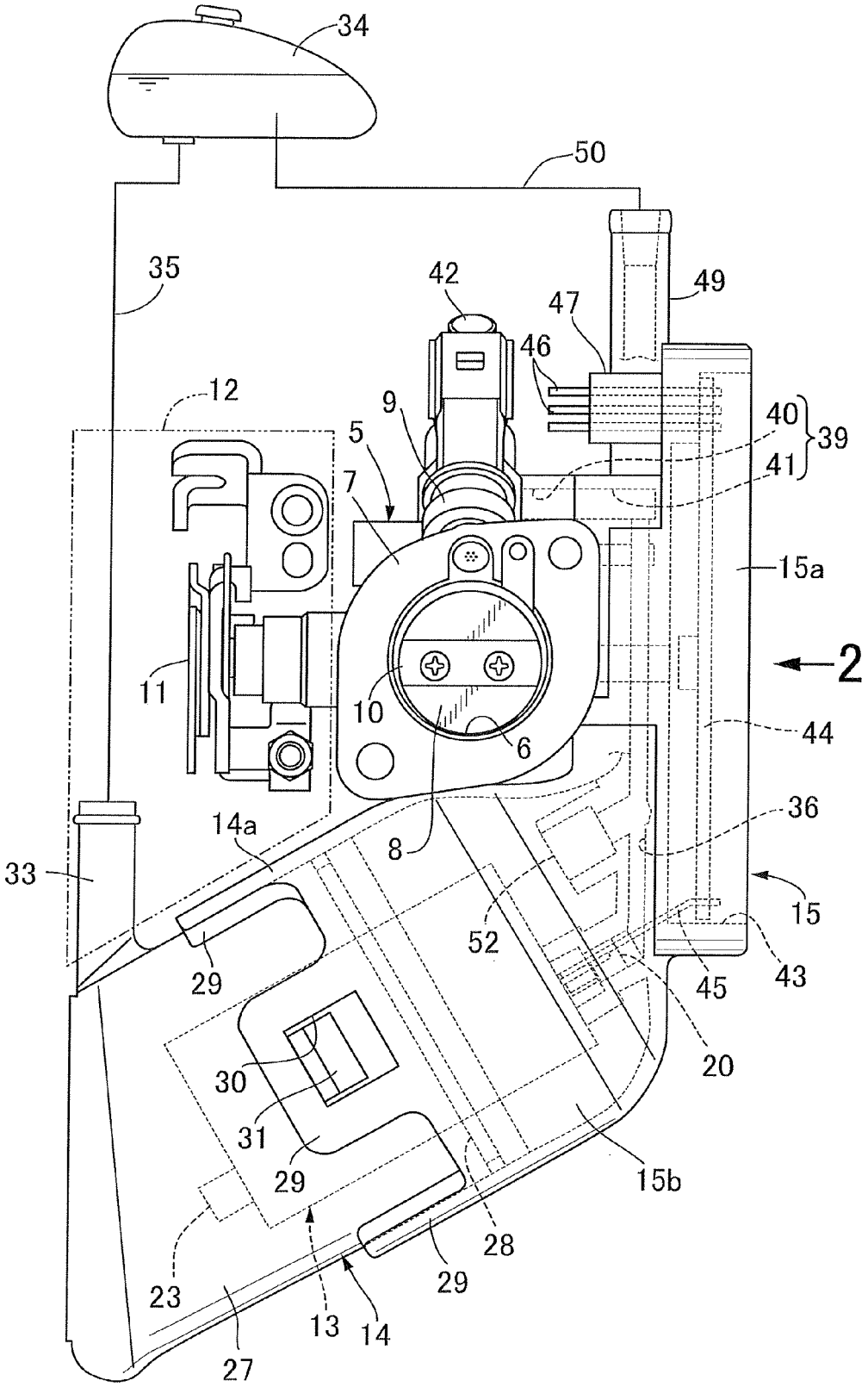
FIG. 1 is a front view showing an arrangement of a fuel supply device for an engine. (first embodiment)

5 Throttle body
6 Intake path
7 Body
8 Throttle valve
9 Fuel injection valve
13 Fuel pump
14 Pump housing case
14*a* Upper side wall of pump housing case
15 Base member
15*a* Base portion
15*b* Housing tube portion
15*c* End wall
20 Discharge orifice
23 Intake orifice
26 Fuel storage chamber
27 Housing cover
28 Seal member
48 Vapor discharge path
51 Passage
52 Regulator

MODES FOR CARRYING OUT THE INVENTION

A mode for carrying out the present invention is explained below by reference to FIG. 1 to FIG. 4, which are attached.

First Embodiment

Figure 2:
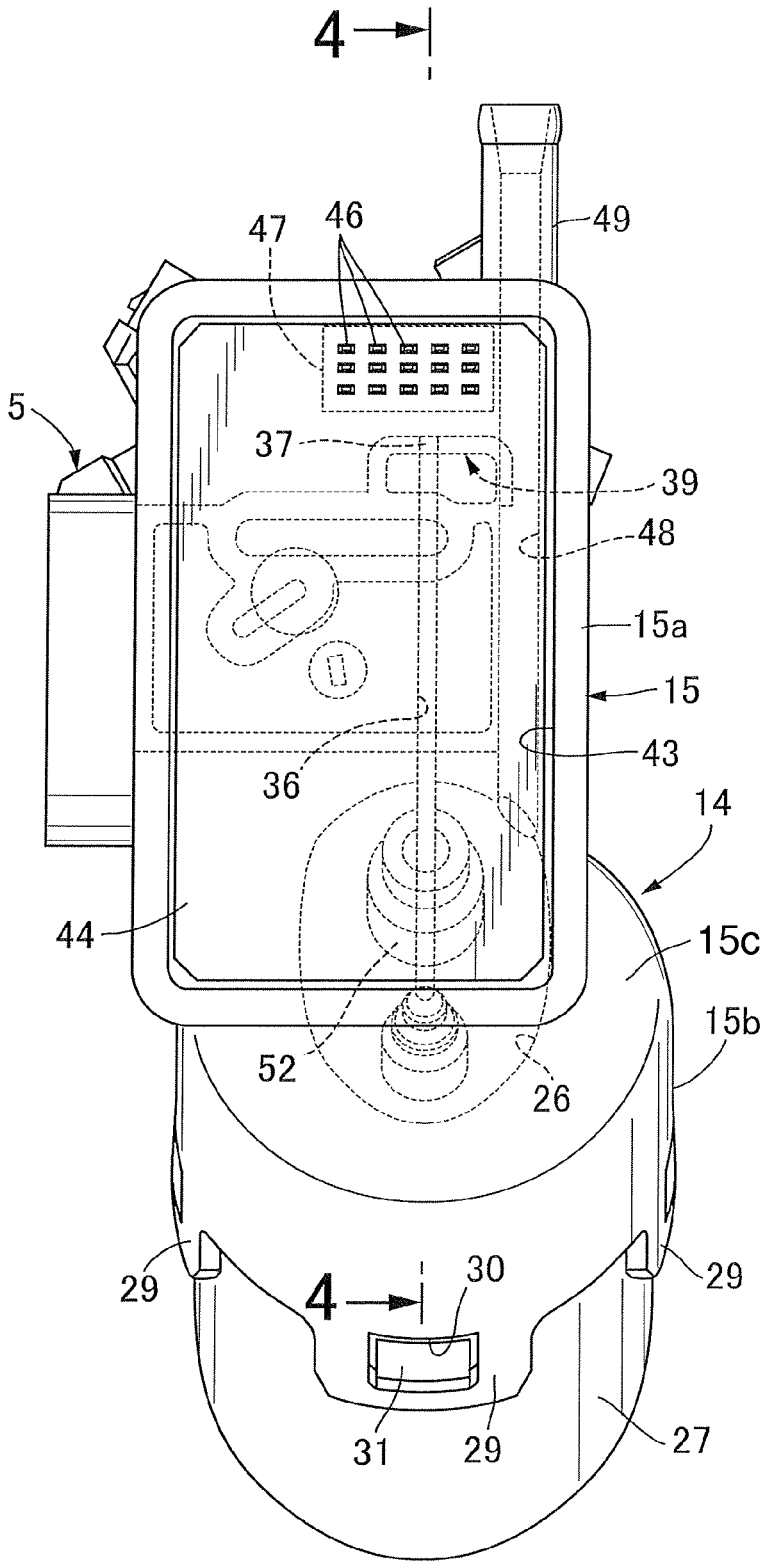
FIG. 2 is a side view in the direction of arrow 2 in FIG. 1. (first embodiment)

First, in FIG. 1 and FIG. 2, a throttle body 5 provided in an intake system of for example an engine for a two-wheeled motor vehicle includes a body 7, made of a synthetic resin, having an intake path 6 communicating with an intake port (not illustrated) of the engine, a butterfly-shaped throttle valve 8 axially supported on the body 7 so as to open and close the intake path 6, and a fuel injection valve 9 mounted on the body 7 so as to inject fuel into the intake path 6 on the downstream side relative to the throttle valve 8.

The throttle valve 8 is fixed to a valve shaft 10 pivotably and axially supported on the body 7 so as to intersect the intake path 6. A throttle drum 11 is fixed to one end part of the valve shaft 10 that projects toward one side of the throttle body 5, a wire, which is not illustrated, being wound around and linked to the throttle drum 11. Furthermore, instead of the throttle drum 11, as shown by a chain line in FIG. 1, an actuator 12 such as an electric motor may be linked to one end part of the valve shaft 10.

Figure 3:
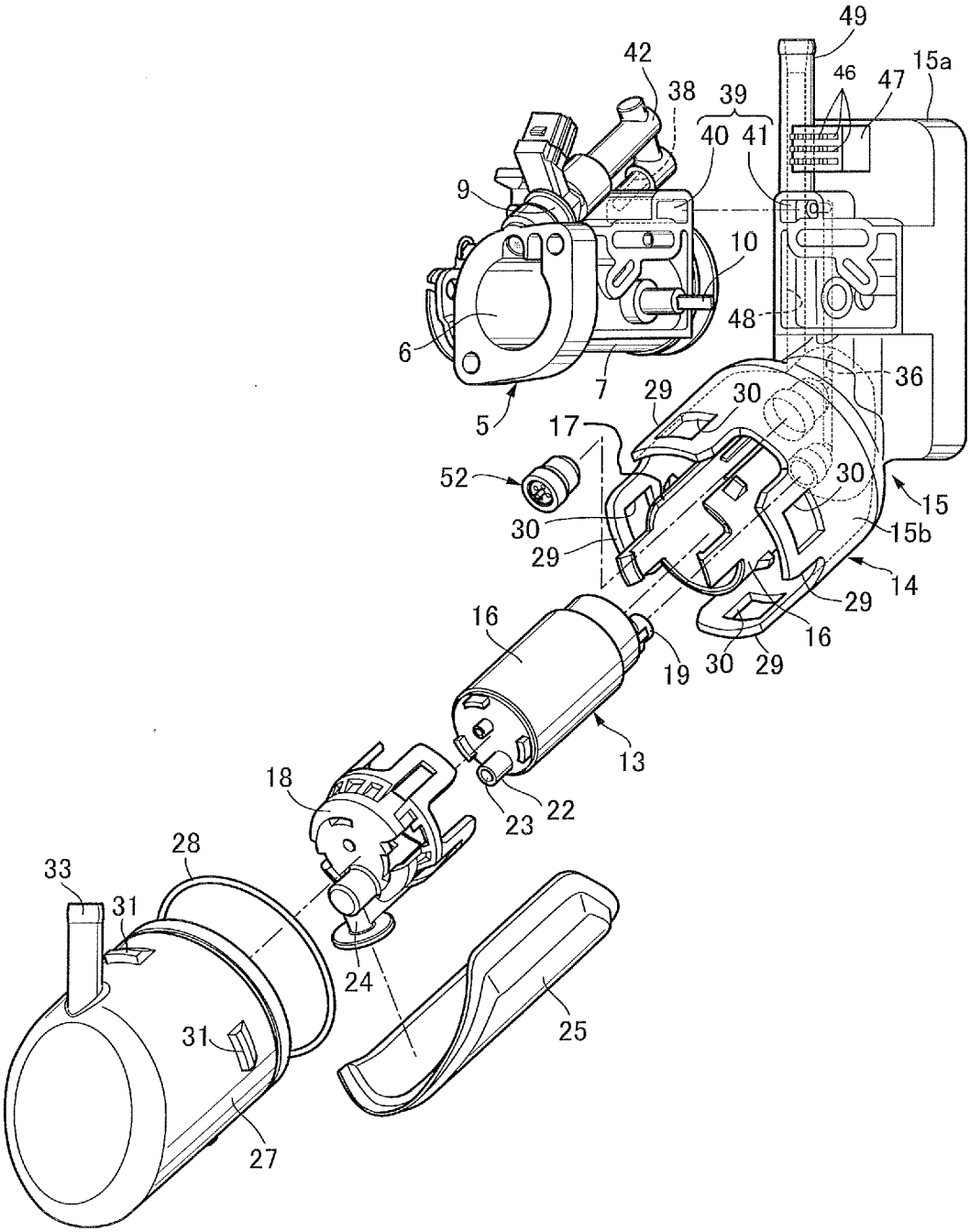
FIG. 3 is an exploded perspective view of the fuel supply device for an engine. (first embodiment)
Figure 4:
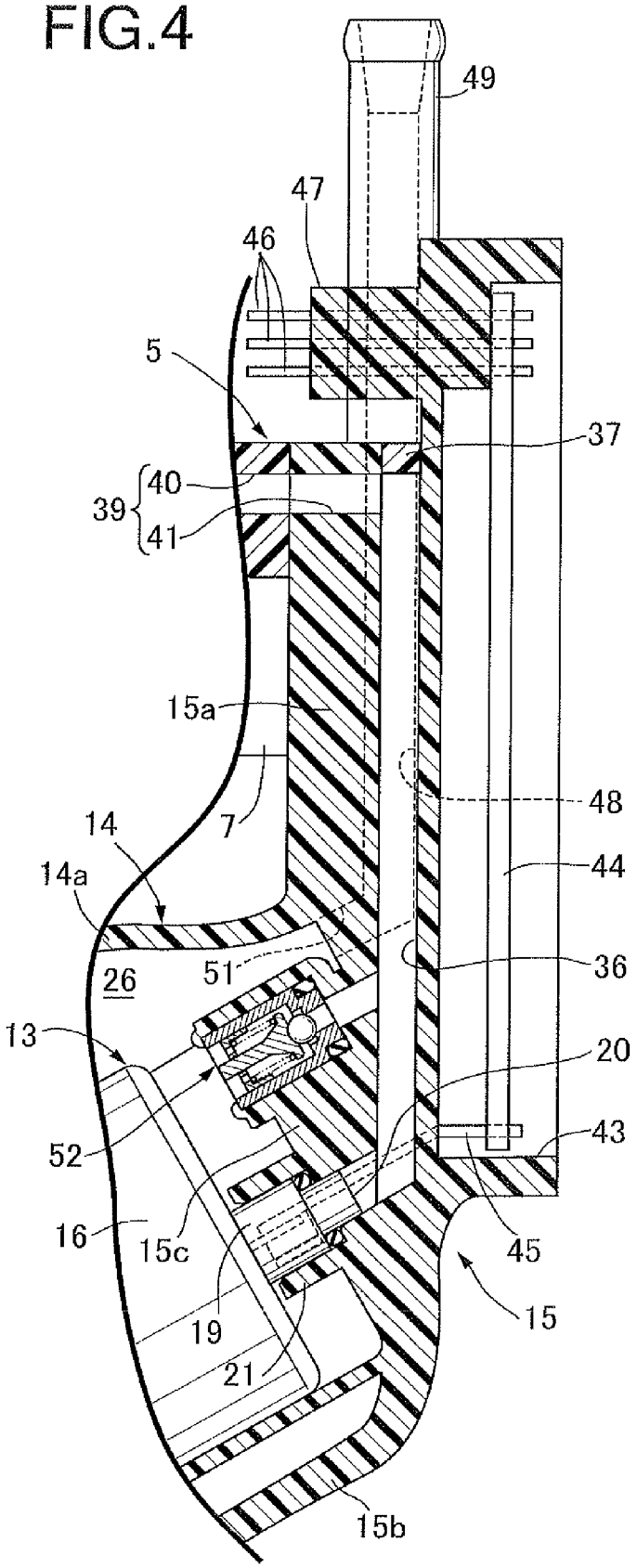
FIG. 4 is a sectional view along line 4-4 in FIG. 2. (first embodiment)

Referring in addition to FIG. 3 and FIG. 4, an electrically operated fuel pump 13 for supplying fuel to the fuel injection valve 9 is attached to the throttle body 5, and the fuel pump 13 is housed in a pump housing case 14. A base member 15 is integrally linked to the body 7 of the throttle body 5, and in this embodiment a base member 15, made of a synthetic resin, that is a separate body from the body 7 is joined to the body 7. This base member 15 is die-molded so as to have a base portion 15*a* extending vertically on the side opposite to the throttle drum 11, and the pump housing case 14 is connectedly provided on a lower part of one side of the base member 15 so that it is disposed on the same side as the direction in which the body 7 is joined to the base member 15, that is, on the same side as the throttle body 5 with respect to the base member 15.

The base member 15 integrally has the base portion 15*a* and a housing tube portion 15*b* housing at least part of the fuel pump 13, and the housing tube portion 15*b* is formed into a bottomed tubular shape, in this embodiment a bottomed cylindrical shape, having on one end side an end wall 15*c* connected to a lower part of the base portion 15*a*. Furthermore, a cylindrical pump retaining tube part 17, disposed substantially coaxially and in a double cylinder manner within the housing tube portion 15*b*, is integrally and connectedly provided on the end wall 15*c*. As shown in FIG. 3, the pump retaining tube part 17 is configured to slidably receive an outlet end of the fuel pump 13 therein. A pump case 16 for the fuel pump 13 is inserted into the pump retaining tube part 17 so that a discharge tube part 19 in one end part of the pump case 16 is liquid-tightly fitted into a connecting tube part 21 provided on the end wall 15*c*. By detachably engaging a cap 18 with an end part, on the side opposite to the base portion 15*a*, of the pump retaining tube part 17, the fuel pump 13 is assembled on the housing tube portion 15*b* integrally and connectedly provided on a lower part on one side of the base portion 15*a*, while making a discharge orifice 20 at the tip of the discharge tube part 19 face toward the base portion 15*a* side.

The cap 18 abuts against the other end of the pump case 16, and a connecting tube 24 is provided on the cap 18. An intake tube part 22 provided at the other end of the pump case 16 and using its tip opening part as an intake orifice 23 is liquid-tightly fitted into the connecting tube 24, and the connecting tube 24 is connected to a filter 25.

The pump housing case 14 houses the fuel pump 13 supported on the lower part on the one side of the base portion 15*a* of the base member 15 and forms a fuel storage chamber 26 for storing fuel to be taken in by the fuel pump 13, and is formed from the housing tube portion 15*b* and a housing cover 27 joined to the housing tube portion 15*b* via an annular seal member 28. The housing cover 27 is formed into a bottomed tubular shape, in this embodiment a bottomed cylindrical shape, that is closed on the side opposite to the base member 15.

An open end part of the housing tube portion 15*b* and an open end part of the housing cover 27 are fitted to each other so as to form a double tube, in this embodiment the open end part of the housing cover 27 being fitted within the open end part of the housing tube portion 15*b*, and the annular seal member 28 is disposed between the housing tube portion 15*b* and the housing cover 27 in the part where they are fitted together.

Projecting parts 29 protruding from the open end of the housing tube portion 15*b* are integrally provided with the housing tube portion 15*b* at a plurality of locations spaced in the peripheral direction. Engagement projections 31 projectingly provided at a plurality of locations of an outer peripheral face of the housing cover 27 engage with engagement holes 30 provided in the respective projecting parts 29, thereby joining the housing tube portion 15*b* and the housing cover 27 to each other to thus form the pump housing case 14.

Moreover, the pump housing case 14 and the fuel pump 13, which is housed within the pump housing case 14 together with the filter 25, take an attitude in which they are inclined upward in going toward the end wall 15*c* integrally provided with the base portion 15*a* of the base member 15, and an upper side wall 14*a* of the pump housing case 14 is also inclined upward in going toward the end wall 15*c* side.

A fuel inlet tube 33 extending upward is provided on an upper part of an end part, on the side opposite to the base member 15, of the housing cover 27 in the pump housing case 14. A fuel supply tube 35 guiding fuel from a bottom part of the interior of a fuel tank 34 disposed at a position higher than the throttle body 5 is connected to the fuel inlet tube 33.

The fuel injection valve 9 is mounted on the body 7 at a position such that the intake path 6 is sandwiched between the fuel injection valve 9 and the pump housing case 14. The throttle drum 11 or the actuator 12 is disposed at a position such that the intake path 6 is sandwiched between the throttle drum 11 or the actuator 12 and the base portion 15*a* of the base member 15 while at least part thereof overlaps the pump housing case 14 in a projection view in a direction (the vertical direction in FIG. 1) perpendicular to the pivot axis of the throttle valve 8 and the central axis of the intake path 6.

A fuel passage 36 guiding fuel from the fuel pump 13 is formed, at the same time as when die molding the base member 15, in the base portion 15*a* of the base member 15 so as to extend in the vertical direction and open in an end part of the base portion 15*a* on the side opposite to the housing tube portion 15*b*, that is, an upper end part of the base portion 15*a*. An opening part of the fuel passage 36 is liquid-tightly closed by means of a lid member 37 press fitted to the upper end part of the base portion 15*a*. Furthermore, as shown in FIG. 4, the discharge tube part 19 provided on one end part of the fuel pump 13 is liquid-tightly fitted, from one side of the base portion 15*a*, into the connecting tube part 21 provided on the end wall 15*c* formed integrally with a lower part of the base portion 15*a*. The discharge orifice 20 at the tip of the discharge tube part 19 communicates with a lower end part of the fuel passage 36 from the one side of the base portion 15*a*.

The body 7 and the base member 15 are joined by welding. A transit chamber 39 is formed between faces of the body 7 and the base member 15 that are joined, the transit chamber 39 providing a connection between the fuel passage 36 and a body-side fuel passage 38 (see FIG. 3), which is provided on the body 7 side. This transit chamber 39 is formed by cooperation between a recess 40 provided in the face of the body 7 facing the base member 15 side and a recess 41 provided in the face of the body 7 member facing the body 7 side.

The body-side fuel passage 38 is formed in the body 7 in substantially the same direction as that of the fuel injection valve 9 relative to the body 7. Opposite end parts of fuel piping 42 having in opposite end parts pipe portions 42*a* and 42*b* disposed in parallel to each other are connected to the body 7 and the fuel injection valve 9 so as to provide a connection between the body-side fuel passage 38 and the fuel injection valve 9.

A housing recess 43 is formed in a portion of the base member 15 that faces the side opposite to the throttle body 5. An ECU board 44 on which an ECU for controlling operation of the fuel pump 13 is disposed is housed in the housing recess 43 so as to be mounted on the base member 15.

Moreover, a bus bar 45 is insert-bonded to the lower part of the base portion 15*a* of the base member 15, that is, the end wall 15*c* of the housing tube portion 15*b*, when die molding the base member 15, the bus bar 45 providing an electrical connection between the ECU board 44 and the fuel pump 13.

The fuel passage 36 is formed in the base portion 15*a* of the base member 15 so as to extend between the ECU board 44 and the body 7 on one side of the bus bar 45.

Furthermore, a terminal support part 47 protruding on the fuel piping 42 side is integrally and projectingly provided on an upper part of the base portion 15*a*, a plurality of terminals 46 connected to the ECU board 44 being insert-bonded when die molding the base member 15 so as to protrude from the terminal support part 47.

A vapor discharge path 48 is formed in the base portion 15*a* of the base member 15 so as to extend vertically and communicate with an upper part within the fuel storage chamber 26, the vapor discharge path 48 discharging vapor generated in the fuel storage chamber 26. This vapor discharge path 48 is formed at the same time as when die molding the base member 15. A return pipe 49 provided in an upper end part of the base portion 15*a* so as to communicate with the upper end of the vapor discharge path 48 is connected to a bottom part of the fuel tank 34 via a return passage 50.

Furthermore, a passage 51 (see FIG. 4) making an upper part within the fuel storage chamber 26 communicate with a lower part of the vapor discharge path 48 is provided in the end wall 15*c* of the housing tube portion 15*b* so as to be horizontal or inclined upward in going toward the vapor discharge path 48 side.

In order to utilize the vapor discharge path 48 as a return passage, a regulator 52 for adjusting the pressure of fuel discharged from the fuel pump 13 is disposed on the end wall 15*c* so as to be present between the fuel storage chamber 26 and the discharge orifice 20 of the fuel pump 13, this regulator 52 being disposed above the discharge orifice 20 of the fuel pump 13, and the intake orifice 23 of the fuel pump 13, that is, the open end of the intake tube part 22, is disposed beneath the discharge orifice 20.

The operation of this embodiment is now explained. Since the base member 15 is integrally linked to the body 7 of the throttle body 5, the pump housing case 14, which is disposed on the same side as the body 7, is connectedly provided on one side of the base member 15 so as to form the fuel storage chamber 26, and the fuel pump 13, which is assembled on the base member 15 from the one side, is housed in the pump housing case 14 so that the discharge orifice 20 faces the base member 15 side, it is possible to achieve a compact arrangement by disposing the throttle body 5 and the fuel pump 13 on one side of the base member 15, the assembly is easy, and a layout that is resistant to vibration can be obtained by supporting the throttle body 5 and the fuel pump 13, which are disposed on one side of the base member 15, by means of the base member 15.

Moreover, since the base member 15, which is separate from the body 7, is joined to the body 7, when the capacity of the fuel pump 13 is changed, only the size on the base member 15 side needs to be changed, and it is unnecessary to make a change to the throttle body 5 side. Furthermore, assembling the body 7 of the throttle body 5 and the base member 15 having the fuel pump 13 preassembled thereon enables the ease of assembly of the fuel pump 13 to be enhanced.

Moreover, since the base member 15 integrally has the base portion 15*a* extending in the vertical direction on one side of the throttle body 5, and the bottomed cylindrical housing tube portion 15*b* having on one end side the end wall 15*c* connected to the lower part of the base portion 15*a* is formed integrally with the base member 15 so as to form part of the pump housing case 14 and support the fuel pump 13 while housing at least part of the fuel pump 13, it is possible to enhance the strength of the part where the housing tube portion 15*b* is connectedly provided on the base member 15, and it is also possible to facilitate the structure for inserting or housing and fixing the fuel pump 13 within the housing tube portion 15*b* while protecting the fuel pump 13.

Furthermore, since the cylindrical pump retaining tube part 17 disposed within the housing tube portion 15*b* in a double cylinder manner is integrally and connectedly provided on the end wall 15*c*, and the pump case 16 of the fuel pump 13 is inserted into the pump retaining tube part 17 so that the discharge tube part 19, which is present at one end part of the pump case 16, is liquid-tightly fitted into the connecting tube part 21 provided on the end wall 15*c*, it is possible to further enhance the strength of the part where the housing tube portion 15*b* is connectedly provided on the base member 15, it is possible to facilitate housing and fixing of the fuel pump 13 within the pump housing case 14, and when there is a requirement to change the axial length of the fuel pump 13, it is unnecessary to make a change to the base member 15.

Moreover, since by detachably engaging the cap 18 with an end part, on the side opposite to the base portion 15*a*, of the pump retaining tube part 17 the fuel pump 13 can be assembled on the housing tube portion 15*b* provided integrally and connectedly with the lower part on one side of the base portion 15*a* while making the discharge orifice 20 at the tip of the discharge tube part 19 face toward the base portion 15*a* side, it is possible to support the fuel pump 13 by means of a simple assembly. Furthermore, due to such an arrangement, even when the size of the fuel pump 13 is changed, it is unnecessary to change the size of the housing tube portion 15*b*, which is integral with the base member 15.

Moreover, since the dimensional relationship between the pump retaining tube part 17 and the pump case 16 of the fuel pump 13 is set so as to be loose, and the fuel pump 13 is supported by the cap 18 and the connecting tube part 21 provided on the end wall 15*c* while making the discharge tube part 19 be fitted in a liquid-tight manner, even when the size of the fuel pump 13 is changed, the fuel pump 13 can be supported only by changing the cap 18, and it is possible to easily change the size of the fuel pump 13.

The pump housing case 14 is formed from the housing tube portion 15*b* and the bottomed tubular housing cover 27 joined to the housing tube portion 15*b* via the seal member 28, and it is possible to protect the fuel pump 13 by forming the pump housing case 14 using a simple structure.

Moreover, since the open end part of the housing tube portion 15*b* and the open end part of the housing cover 27 are fitted to each other so as to overlap in a double tube manner, it is possible to contribute to an improvement in the strength of the pump housing case 14 while facilitating replacement of the fuel pump 13 when maintenance is carried out.

Furthermore, since the fuel injection valve 9 is mounted on the body 7 at a position such that the intake path 6 of the throttle body 5 is sandwiched between the fuel injection valve 9 and the pump housing case 14, and the throttle drum 11 linked to the throttle valve 8 or the actuator 12 for opening and closing the throttle valve 8 is disposed at a position such that the intake path 6 is sandwiched between the actuator 12 or the throttle drum 11 and the base member 15 while at least part thereof overlaps the pump housing case 14 in a projection view in a direction perpendicular to the pivot axis of the throttle valve 8 and the central axis of the intake path 6, it is possible to utilize space effectively by disposing effectively the throttle drum 11 or the actuator 12 in a space formed on the throttle body 5 side of the pump housing case 14, and it is also possible to facilitate assembly of the throttle drum 11 or the actuator 12. Moreover, it is possible to easily switch between a state in which the throttle valve 8 is driven by the throttle drum 11 and a state in which the throttle valve 8 is driven by the actuator 12.

Furthermore, since the base member 15 is die-molded, the base portion 15*a* integral with the base member 15 extends in the vertical direction on one side of the body 7 of the throttle body 5 and is joined to the body 7, the fuel passage 36 guiding fuel from the fuel pump 13 toward the fuel injection valve 9 side is formed on the base portion 15*a* at the same time as when die molding the base member 15 so as to open on the other end part on the side opposite to the housing tube portion 15*b*, and the opening part of the fuel passage 36 is liquid-tightly closed by the lid member 37, it is unnecessary to carry out special machining in order to form the fuel passage 36, thus simplifying the fuel passage structure. Moreover, the inner wall face of the fuel passage 36 exhibits the function of a rib, thus enhancing the strength of the base member 15. Furthermore, since the open end of the fuel passage 36 is not disposed on the housing tube portion 15*b* side there is no hole or cutout, due to a mold for forming the fuel passage 36, in the part where the housing tube portion 15*b* is connectedly provided on the base member 15, and it is possible to contribute to an improvement in the strength of the connectedly provided part. Moreover, due to the fuel passage 36 being formed in the base member 15, a partition separating the side where the body 7 and the fuel pump 13 are present from the side where the body 7 and the fuel pump 13 are not present can be formed on the base member 15, and since no hole or cutout due to a mold for forming the fuel passage 36 is formed in the base member 15, it is possible to contribute to an improvement in the strength and toughness.

Furthermore, since the discharge orifice 20 of the fuel pump 13 communicates with the lower part of the fuel passage 36 so as to liquid-tightly fit, from one side of the base portion 15*a*, the discharge tube part 19 into the connecting tube part 21 provided on the end wall 15*c* connected to the lower part of the base portion 15*a*, it is possible to easily make the discharge orifice 20 of the fuel pump 13 communicate with the fuel passage 36 while supporting the fuel pump 13 by the base member 15 with a simple assembly.

Moreover, since the transit chamber 39, which provides a connection between the fuel passage 36 and the body-side fuel passage 38 formed in the body 7 so as to be connected to the fuel injection valve 9, is formed between the joined faces of the body 7 and the base member 15, which are joined to each other, not only is it possible to easily form the transit chamber 39 advantageously in terms of layout by eliminating the need for providing the transit chamber 39 in a place other than the base member 15 and the body 7, but it is also possible to reduce the cost.

Furthermore, since the body-side fuel passage 38 is formed in the body 7 in substantially the same direction as the fuel injection valve 9 relative to the body 7, the body-side fuel passage 38 can easily be formed by molding or machining, and opposite end parts of the fuel piping 42 having in opposite end parts the pipe portions 42*a* and 42*b*, which are disposed in parallel to each other, are connected to the body 7 and the fuel injection valve 9 so as to link the body-side fuel passage 38 and the fuel injection valve 9, an operation of connecting the fuel piping 42, which links the body-side fuel passage 38 and the fuel injection valve 9, becomes easy. Moreover, the body-side fuel passage 38 can be disposed at any position as long as it is a position that communicates with the transit chamber 39, and it is possible to reduce the size of the fuel piping 42 while making it easy to set the shape thereof. Furthermore, fuel is made to flow through part of the body 7, thus contributing to cooling of the body 7.

Moreover, since the body 7 and the base member 15 are both formed from a synthetic resin and welded to each other, it is possible to reduce the number of components by eliminating the need for a securing member, etc., thus cutting the cost, and it is also possible to enhance the strength of the part where the body 7 and the base member 15 are joined while easily forming the transit chamber 39.

Since the housing recess 43 housing a component is formed in a portion of the base member 15 facing the side opposite to the throttle body 5, and the ECU board 44 is mounted on the body 7 member so as to be housed in the housing recess 43, when the fuel pump 13 and the ECU board 44 are both assembled they do not interfere with each other, assembly becomes easy, the base member 15 can be reinforced, and housing the ECU board 44 within the housing recess 43 enables the ECU board 44 to be protected.

Moreover, since the bus bar 45, which provides an electrical connection between the ECU board 44 and the fuel pump 13, is insert-bonded to the base member 15, it becomes easy to carry out electrical connection of the fuel pump 13 to the ECU board 44, and it becomes possible by means of the bus bar 45 to enhance the strength of the part where the housing tube portion 15*b* is connectedly provided on the base member 15.

Furthermore, since the fuel passage 36 is disposed so as to extend between the ECU board 44 and the body 7 on one side of the bus bar 45, it is possible to cool the bus bar 45 and the ECU board 44 by means of fuel flowing through the fuel passage 36.

Since in the base portion 15*a* of the base member 15 the vapor discharge path 48, which discharges vapor generated in the fuel storage chamber 26 within the pump housing case 14, is formed so as to extend in the vertical direction and communicate with the upper part of the fuel storage chamber 26, it is possible to remove effectively vapor generated within the fuel storage chamber 26, and it is possible to simply form the vapor discharge path 48 by machining or die-molding. Furthermore, it is possible to employ a compact structure while eliminating the necessity for specially disposing a vapor discharge path in a portion other than the base portion 15*a*, it is unnecessary to assemble a special component for forming the vapor discharge path 48 and, moreover, it is possible to enhance the strength of the base portion by an inner wall face of the vapor discharge path 48 exhibiting the function of rib. Moreover, since the base member 15 is die-molded, it is possible to form the bottomed tubular housing tubular portion 15*b* forming part of the pump housing case 14 at the same time as the base portion 15*a*, and since the vapor discharge path 48 is formed when die molding the base member 15, it is unnecessary to carry out special machining in order to form the vapor discharge path 48, thereby enabling the housing tubular portion 15*b* and the vapor discharge path 48 to be formed simply and simultaneously.

Furthermore, since the passage 51 making the upper part within the fuel storage chamber 26 communicate with the lower part of the vapor discharge path 48 is provided in the end wall 15*c* of the housing tube portion 15*b* so as to be horizontal or inclined upward in going toward the vapor discharge path 48 side, it is possible to easily vent vapor of the fuel storage chamber 26 toward the vapor discharge path 48 side. Moreover, since the passage 51 is provided in the end wall 15*c* of the bottomed cylindrical housing tubular portion 15*b* provided integrally with the base member 15, it is possible to easily form the passage 51 by removing a die from the open end of the housing tubular portion 15*b* when die molding the base member 15.

Furthermore, since the upper side wall 14*a* of the pump housing case 14 is disposed so as to be horizontal or inclined upward in going toward the base portion 15*a* side, it is possible to more easily vent fuel within the fuel storage chamber 26 toward the vapor discharge path 48 side.

Moreover, since the regulator 52, which adjusts the pressure of fuel discharged from the fuel pump 13, is disposed on the end wall 15*c* so as to be present between the discharge orifice 20 of the fuel pump 13 and the fuel storage chamber 26 in order to utilize the vapor discharge path 48 as a return passage, it is possible to employ a compact structure by eliminating the necessity for additionally providing a return passage other than the vapor discharge path 48, and vapor contained in fuel that has returned from the regulator 52 toward the fuel storage chamber 26 side escapes from the upper part of the fuel storage chamber 26 toward the vapor discharge path 48 side. Furthermore, since the regulator 52 is disposed on the end wall 15*c* of the bottomed cylindrical housing tubular portion 15*b* provided integrally with the base member 15, it is possible to easily assemble the regulator 52 from the open end side of the housing tubular portion 15*b*.

Furthermore, since the regulator 52 is disposed above the discharge orifice 20 of the fuel pump 13, and the intake orifice 23 of the fuel pump 13 is disposed beneath the discharge orifice 20, it is possible to make it difficult for vapor contained in fuel that has returned from the regulator 52 toward the fuel storage chamber 26 side to be sucked up by the fuel pump 13, and it is also possible to shorten the length of the passage for guiding fuel returning from the regulator 52 toward the fuel storage chamber 26 side.

Moreover, since the fuel pump 13 is housed in the pump housing case 14 so that the fuel pump 13 is inclined upward in going toward the end wall 15*c* side, it is possible to more easily vent vapor within the fuel storage chamber 26 toward the vapor discharge path 48 side.

An embodiment of the present invention is explained above, but the present invention is not limited by the embodiment and may be modified in variety of ways as long as the modifications do not depart from the spirit and scope thereof.

The invention claimed is:

1. A fuel supply device for an engine in which a throttle body, that comprises a body having an intake path communicating with an intake port of the engine, a throttle valve axially supported on the body so as to open and close the intake path, and a fuel injection valve mounted on the body so as to inject fuel into the intake path, is provided with an electrically operated fuel pump that supplies fuel to the fuel injection valve, characterized in that:

a base member, integrally having a base portion that extends in a vertical direction on one side of the throttle body and a housing tube portion that is formed into a bottomed tube shape, the housing tube portion having on one end side an end wall formed therein and communicating with a lower part of the base portion, wherein the base member is linked integrally to the body, a substantially cylindrical pump-retaining tube part is provided substantially coaxially inside of the housing tube portion, the pump-retaining tube part configured to slidably receive an outlet end of the fuel pump therein, a pump housing case, that houses the fuel pump and forms a fuel storage chamber, is formed from the housing tube portion and a bottomed tubular housing cover joined to the housing tube portion via a seal member, and is disposed beneath the body, the throttle valve is fixed to a valve shaft pivotably and axially supported on the body so as to intersect the intake path, a throttle drum is fixed to, or an actuator is linked to, one end part of the valve shaft of the throttle body, the throttle body is disposed on one side of the base member, the housing tube portion that houses the fuel pump is disposed beneath the throttle body and on one side of the base portion, and a bus bar, for providing an electrical connection between an ECU board and the fuel pump, is insert-bonded to a part of the housing tube portion that is connected to the base portion.

2. The fuel supply device for an engine according to claim 1, wherein a housing recess is formed in a portion of the base member that faces a side opposite to the throttle body, and the ECU board is housed in the housing recess.

3. The fuel supply device for an engine according to claim 1, wherein the bus bar acts as a reinforcing member interconnecting the base portion and the housing tube portion.

4. The fuel supply device for an engine according to claim 1, further comprising a cap for placing over the pump-retaining tube part and for covering an inlet end of the fuel pump.

5. The fuel supply device for an engine according to claim 1, wherein the fuel pump has a central axis which is disposed at an angle in relation to the base member.

* * * * *